United States Patent [19]

Kumpfer, deceased et al.

[11] 4,310,786

[45] Jan. 12, 1982

[54] MAGNETRON TUBE WITH IMPROVED LOW COST STRUCTURE

[76] Inventors: Beverly D. Kumpfer, deceased, late of Salt Lake City, Utah; Mary Belle Krumpfer, executrix, 4335 Spruce Cir., Salt Lake City, Utah 84117

[21] Appl. No.: 74,670

[22] Filed: Sep. 12, 1979

[51] Int. Cl.[3] ..... H01J 25/50

[52] U.S. Cl. ..... 315/39.51; 315/39.71; 315/39.75

[58] Field of Search ..... 315/39.51, 39.75, 39.71, 315/39.53

[56] References Cited

U.S. PATENT DOCUMENTS

| | | | |
|---|---|---|---|
| 2,782,342 | 2/1957 | Kilgore | 315/39.53 X |
| 3,076,122 | 1/1963 | Kumpfer | 315/39.71 |
| 3,543,082 | 11/1970 | Boehm | 315/39.71 |
| 3,551,735 | 12/1970 | Staats | 315/39.77 |
| 3,846,667 | 11/1974 | Hisada et al. | 315/39.71 |
| 4,048,542 | 9/1977 | Miura | 315/39.51 |
| 4,104,559 | 8/1978 | Hobbs | 315/39.51 |
| 4,131,824 | 12/1978 | Nakai et al. | 315/39.51 |
| 4,163,175 | 7/1979 | Tashiro | 315/39.51 |

*Primary Examiner*—Saxfield Chatmon, Jr.

[57] ABSTRACT

A magnetron electron discharge device preferably for use in microwave heating or cooking apparatus has a cylindrical resonant anode structure surrounding a concentric electron emitting filament which is supported directly between re-entrant end closures housing magnet members which are external to the vacuum envelope but are so located as to achieve high magnet circuit efficiency, rugged construction and low spurious noise output.

10 Claims, 8 Drawing Figures

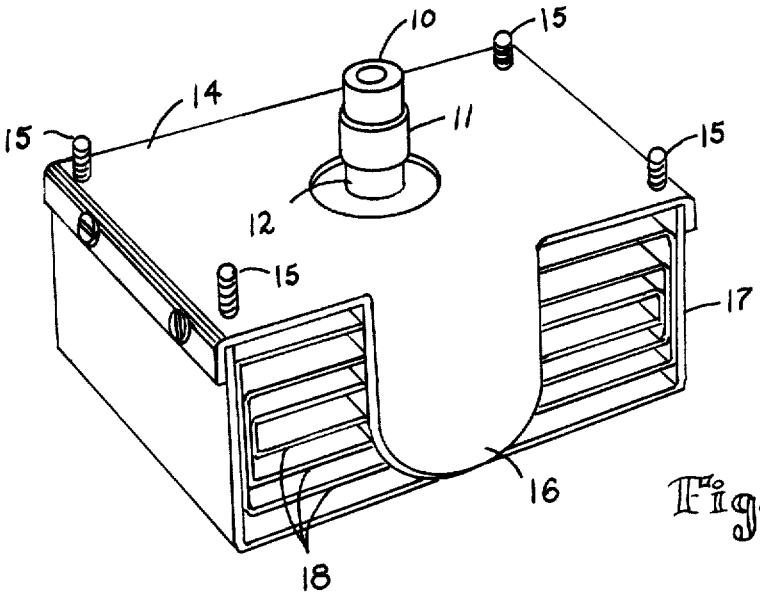
Fig. 1.
FIG. 4
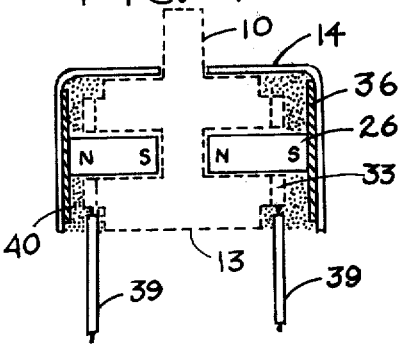
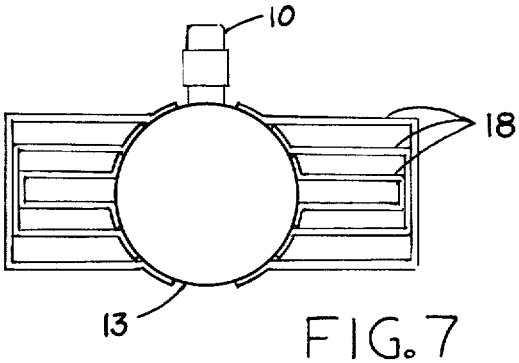
FIG. 7
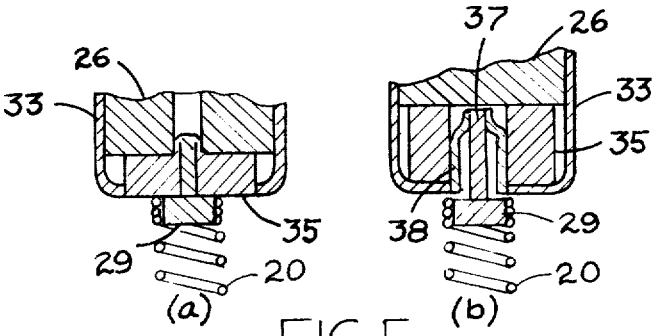
FIG. 5

SECTION A-A (FIG 2)

MAGNETRON TUBE WITH IMPROVED LOW COST STRUCTURE

BACKGROUND OF THE INVENTION

Since 1947, magnetrons have undergone extensive development directed principally toward their evolution from the very expensive transmitters used in World War II radar to the present low cost and highly reliable units applicable to use in a kitchen appliance. This effort has reduced the magnetrons cost from several hundreds of dollars for the early cooking magnetrons to less than $20.00 wholesale cost for the present high production tubes. This downward trend continues, although at a lower rate, in spite of steadily increasing labor and materials costs. Along with price reduction, great strides have also been made in compactness and reliability, resulting in greater design freedom and longer life.

Recently, however, because of world affairs impacting the cost of cobalt metal used in the magnet circuit of most magnetrons, much development effort has been expended in reducing the amount of magnetic material required, and hence the cost, of magnetrons using permanent magnets. A substitute for cobalt bearing magnets has been found in ferrite materials, but these have thermal temperature cooefficients almost one order of magnitude (nine times) greater than the cobalt based materials and so are not stable in microwave ovens which have high or changing ambient temperatures such as those using resistance heated browning elements. In addition, ferrite magnets have greater bulk and are subject to cracking due to temperature gradients.

It has become well known that the efficiency of the magnetic circuit of a magnetron is improved as the magnetic material is moved closer to the working gap, since leakage flux is thereby reduced. Early cooking magnetrons had magnetic circuit figures of merit of only 0.3% but due to the development trend to minimize cobalt costs, this figure has been extended over ten times in the last ten years. Recently, in order to optimize this figure, it has been considered necessary to include the cobalt-containing material (such as the Alnico or samarium-cobalt alloys) within the vacuum envelope of the magnetron. This practice has dissadvantages in that the outgassing (pumping) time of the device is considerably increased with attendant cost increase.

Another dissadvantage of the conventional magnetron design is that the magnetic pole pieces adjacent to either end of the electron emitting filament are at positive potential with respect to the electron emitter. The result is that some electrons are therefore attracted axially to the positive pole pieces, reducing the efficiency of the magnetron and also causing excess noise generation during the build-up of coherent oscillations. Such noise is very broad spectrally, causing interference to other services such as televisin, microwave communications, and radio receivers. To prevent the radiation of such noise components, as required by governmental agencies, necessitates the addition of radiation filter components which add appreciably to the manufacturing cost of the magnetron, as well as to its bulk.

Another problem with the prior art magnetron structure is that the filament is cantilever supported from one end and constitutes an assembly having two distinct mechanical resonances the vibrating masses of which are joined by the thoriated tungsten emitting material which, after conversion to tungsten carbide, in the process known as carburizing, is extremely brittle. As a consequence, any mechanical shock or vibration during shipping or rough handling, subjects the filament to stresses which often result in breakage. Also, since the filament and both end hats and the center rod operate at very high temperatures, they must be made of exotic and expensive metals such as tungsten and molybdenum and joined with expensive materials such as platinum, ruthenium, or rutanium-molybdenum alloys which add greatly to the expense of manufacture. Also, because of the high operating temperatures, cantilever supported filaments are usually restricted to operation only in the vertical position to prevent sagging, or mechanical deformity due to gravity.

SUMMARY OF THE INVENTION

It is therefore an overall objective of the present invention to provide an improved magnetron for microwave ovens which substantially overcomes the above limitations of the prior art devices: (a) It is an objective to provide a magnetron electron tube for microwave ovens which is more compact than the current conventional design. (b) It is another objective to provide such a magmetron tube for microwave cooking and other heating applications which is more economical to manufacture because of simplified assembly, the elimination of expensive metals such as molybdenum, tungsten, platinum, monel, and Kovar, and the elimination of costly components required with the conventional design for the supression of spurious radiation. (c) It is yet another objective of the present invention to minimize the generation of spurious radiation, including harmonic radiation, through the use of a unique geometry. (d) The electron discharge device of the present invention also provides a structure which is extremely rugged against breakage caused by shock and vibration. (e) A yet further purpose of the disclosed structure is the realization of increased magnet circuit efficiency by permitting the symmetrical magnets to be inserted to a position immediately adjacent to the working gap, yet not included within the vacuum envelope of the magnetron. (f) A further objective is the provision of a magnetron tube which can be used in any mounting position.

BRIEF DESCRIPTION OF THE DRAWINGS

FIG. 1 is a perspective view of a completed magnetron tube constructed in accordance with the teachings of the present invention after the addition of cooling fins, mounting plate and magnet circuit.

FIG. 4 is a schematic, cross-sectional representation of the magnetic circuit of the improved magnetron indicating the location of the magnets and high voltage insulators.

FIG. 5 (*a*) and (*b*) are partial, cross-sectional views of alternative constructions of the filament support structure.

FIG. 7 shows the method of cooling the finished magnetron of FIG. 1.

DESCRIPTION OF THE INVENTION

Figure 2:
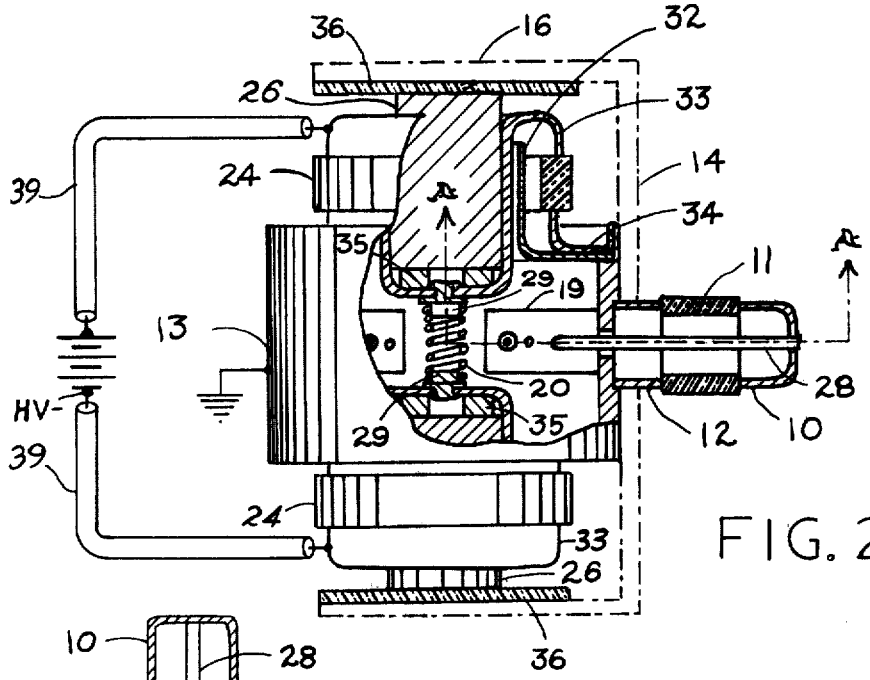
FIG. 2 is a partial, cross sectional view of the magnetron vacuum device which forms the core of the finished magnetron of FIG. 1.

FIG. 1 shows a perspective view of a finished magnetron constructed in accordance with the teachings of my invention. The antenna consists of a metallic end cap 10, an insulating cylinder 11 of glass or, preferably, ceramic 11 and a metallic base cylinder 12, all hermetically sealed to one another and to anode body 13, not visable in FIG. 1. A mounting plate 14 is constructed of metal and fitted with mounting screws 15 for attaching the megnetron ot a waveguide or other device for removing the useful energy generated by the magnetron. A pair of ferrous extensions perpendicular to the mounting plate 14 form magnet return path 16 which may be an integral part of mounting plate 14, or may be a seperate part, provide a return path for the magnetic flux produced by the magnets 26, not visable. A channel shaped member 17 is attached to each end of mounting plate 14 to form an air duct for guiding the required cooling air. Cooling fins 18 are constructed of a highly thermally conducting material such as aluminum and are supported in intimate thermal contact with the magnetron anode body 13 by air duct 17 as shown in FIG. 7.

Figure 3:
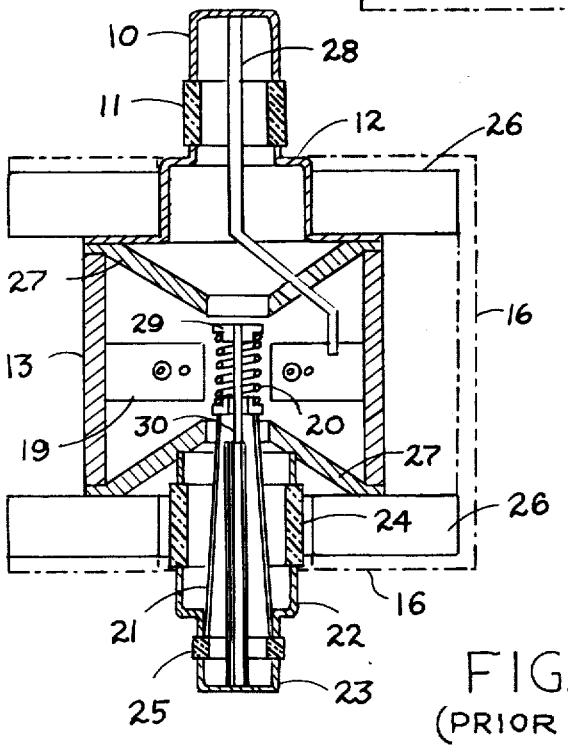
FIG. 3 (PRIOR ART)
FIG. 3 is a plane, cross sectional view of a magnetron vacuum tube of the prior art for comparison with FIG. 2, wherein corresponding parts bear like designations.

Prior to proceeding to a detailed discription of the present invention as illustrated in FIG. 2, it will be helpful to examine the construction of a typical magnetron of the prior art as shown in FIG. 3. A cylindrical anode structure 13 supports a radial array of vanes 19 which extend inwardly to form a multi-cavity resonator circuit surrounding electron emitting filament 20 and is concentric therewith. Filament 20 is supported by cantilever structures 21 and 30 connected to electrical terminals 22 and 23 and is electrically isolated from anode 13 by insulator 24 and terminals 23 and 24 are isolated from each other by insulator 25. Magnets 26 cooperate with pole-pieces 27 to produce a magnetic field in the electron interaction space between anode vanes 19 and the emitting filament 20. A ferrous metal yoke 14 shown in phantom lines in FIG. 3 provides a magnetic return path between the outer extremities of magnets 26. Antenna 28 is connected to one or more vanes 19 for the purpose of removing generated microwave power from the resonator and delivering it to a useful load. Since in this known structure, end hats 29, center rod 30 and support member 21 all operate at elevated temperatures approaching that of emitting filament 20, they must be constructed of expensive high temperature metals such as molybdenum or tungsten and assembled with alloys containing platinum, molybdenum, ruthenium or rutanium. Operation at such elevated temperatures also gives rise to unwanted emission from end hats 29 and mechanical sagging of the structure when used with the axis horizontal.

Now in FIG. 2, wherein similarly functioning parts bear symbol designations corresponding to the prior art device of FIG. 3, the advantages of the improved structure of the present invention are illustrated. The emitting filament 20, which consists of a helix of thoriated tungsten wire, is directly affixed at both ends to metallic support cylinders 29 (designated "end hats" 29 in FIG. 3) preferably by an interference fit, frictional joint according to the teachings of my prior U.S. Pat. No. 3,566,179 "CATHODE AND HEATER CONSTRUCTIONS AND MOUNTINGS IN ELECTRON DISCHARGE DEVICES" issued Feb. 23, 1971. No other means of attachment is usually necessary since the temperature of support cylinders 29 do not reach the mechanical yield temperature of the end turns of tungsten filament wire 20, although brazing or welding of filament 20 to support cylinders 29 can be employed, although at additional manufacturing cost. Filament support cylinders 29 are in turn brazed, welded or are formed as integral parts of end closure 33 and are coaxial therewith. As in FIG. 3, anode structure 13 consists of circular array of resonators 19 which may be of any type known to the prior art such as vane, hole-and-slot, interdigital or rising sun types (See M.I.T. Radiation Laboratories Radar Series, G. B. Collins, Vol. 6) Anode structure 13 surrounds and is concentric with filament 20. Insulators 24 are brazed or otherwise hermetically sealed to anode structure 13 and end closures 33 to complete the vacuum enclosure and to maintain these parts in concentric relationship. End closures 33 are formed of a non-ferrous material to provide deeply re-entrant hollow cylindrical receptacles for magnets 26 and field shaping pole-pieces 35 where needed. In the preferred embodiment depicted in FIG. 5(*a*) further improvement in magnetic circuit efficiency is achieved by incorporating field shaping pole-pieces 35 in the inner ends of end closures 33 in a manner such that the magnetic gap is reduced by two times the thickness of the non-ferrous material comprising end closures 33. This location of magnets 26 immediately adjacent to the electron interaction space defined by the inner diameter of anode circuit 13 and the outer diameter of electron emitting filament 20 serves to maximize magnetic circuit efficiency while at the same time maintaining the magnets 26 outside of the vacuum envelope. Such mounting and location of magnets 26 renders them easily removable from the magnetron structure for reuse. By the present design a magnetic circuit figure of merit of over 5% is achieved as compared with approximately 0.9% for the prior art design of FIG. 3.

A magnetic return path is provided by plates 16 made of a low reluctance ferrous material such as cold rolled steel connecting the outer extremities of magnets 26 as shown as phantom lines in FIG. 2 and may in the preferred embodiment, also provide a mounting surface 14 for the magnetron and a ground plane for antenna 10. Magnets 26 which are at high negative potential with respect to grounded magnetic return path 16 are isolated therefrom by means of dielectric insulators 36 which may be thin sheets of high voltage, high temperature material such as Teflon or ceramic.

Figure 6:
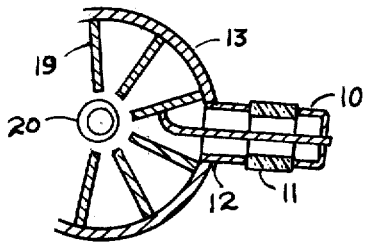
FIG. 6 illustrates the method of coupling microwave energy from the magnetron anode.

As shown in FIG. 6, antenna wire 28 connects antenna cap 10 to resonator vanes 19 and forms an inductive loop for coupling out microwave energy. Antenna cap 10 is otherwise isolated from anode 13 by means of cylindrical insulator 11 which may be of glass or ceramic hermetically sealed at each end.

Microwave leakage from the filament 20 and end closures 33 through insulators 24 is minimized by a cylindrical capacitative member 32 supported and integral with annulus 34 which is supported in turn by anode body 13 and maintained concentric with and in close proximity to end closures 33 to form microwave chokes approximately one-quarter wavelength long at the operating frequency.

Thus, the structure, which is symmetrical about its axial midplane, provides an extremely rugged, simple assembly which eliminates the use of most exotic, expensive, high temperature metals in the filament structure. Furthermore, noise generation is reduced by virtue of the elimination of leakage currents to pole pieces 27 (FIG. 3) since in my improved structure end closures 33 operate at the same potential as the emitting filament 20.

An alternative method of supporting helical filament 20 and cylindrical metallic supports 29 is depicted in FIG. 5(*b*). In this embodiment, adjustment of the operating temperature of supports 29 is made possible by providing a longer heat conducting path to permit supports 29 to operate closer to the yield point of emitting filament 20 so as to reduce the effects of end cooling. A temperature of 650° Centigrade at the end turns of helical emitting filament 20 can be tolorated before contact tension is lost. Small diameter extensions 37 of support cylinders 29 are welded or otherwise hermetically affixed to re-entrant cylinders 38 which in turn, are hermetically affixed to end closures 33 to support emitting filament 20 essentially concentric with anode structure 13. To permit support cylinders 29 to operate at temperatures above 250° Centigrade, filament 20 may be welded or brazed to support cylinders 29 which is then constructed of a metal such as molybdenum.

To further reduce microwave leakage through insulators 24, and to increase the high voltage breakdown capacity between the outer surfaces of end closures 33 and other parts at ground potential, such as anode 13 and magnet return path 16, the space between these parts is filled with a mixture of a high voltage, high temperature material such as RTV silicone rubber and particals of a microwave absorptive material such as ferrite granules or powder as shown as a stippled area 40 in FIG. 4 which also shows the details of the magnetic circuit in greater particularity. The ends of filament connections 30 which apply filament voltage and negative high voltage to end closures 33 for the operation of the magnetron, are also encapsulated in the high voltage insulating material 40.

What is claimed is:

1. A magnetron for the generation of microwave oscillations comprising:

a multicavity cylindrical anode structure;

end closures at both ends of said anode structure and insulated therefrom consisting of re-entrant, closed-ended hollow sections defining a vacuum enclosure;

an electron source consisting of a helical metallic filament coaxial with said cylindrical anode structure and connected at both ends by means of cylindrical metallic support members affixed to or integral with the inside flat surfaces of said re-entrant end closures;

electrical conductors connected to each of said end closures for the purpose of heating said filament to electron emitting temperature by passing an electrical current therethrough and for rendering said end closures and said filament at high negative potential with respect to said anode structure;

output means consisting of a coaxial transmission line connected between said anode structure and one or more anode resonators and having its center conductor terminated in an antenna with its axis perpendicular to the axis of said anode structure;

mode suppression means connected to alternate sets of alternate resonators and consisting of metallic conductors;

magnets adjacent to said end closures configured to produce a magnetic field in the interaction space between said anode and said filament in a direction parallel to the axis of said anode and said filament and at the same electrical potential as said filament;

microwave leakage suppression means consisting of coaxial choke sections of predetermined length relative to the operating frequency of said magnetron supported by said anode structure and surrounding said re-entrant portions of both end closures in close proximity;

a magnetic return path for guiding magnetic flux lines from the outer extremity of the first said magnet to the outer extremity of the second said magnet and insulated therefrom;

cooling means in thermal contact with said cylindrical anode outer surface.

2. The magnetron in accordance with claim 1 in combination wherein said helical metallic filament is connected to said re-entrant end closures at both ends by a frictional interference fit to said cylindrical metallic support members connected electrically and thermally to said end closures.

3. The magnetron in accordance with claim 1 in combination wherein said helical filament is brazed or welded to said cylindrical support members integral with or affixed to said end closures at both ends.

4. The magnetron of claim 1 in combination wherein said re-entrant end closures are deeply re-entrant to form a cylindrical recess closed at its innermost end to enclose and align said magnets adjacent to said interaction space.

5. The magnetron of the combination of claim 1 in which said deeply re-entrant end closures are of nonferrous material except for the closed innermost ends which are constructed of a ferrous material.

6. The magnetron in accordance with claim 1 in combination in which said magnetic return path also incorporates a planar mounting surface for said magnetron.

7. The magnetron of claim 1 in combination in which said magnets are easily removable for re-use.

8. The magnetron in accordance with the combination of claim 1 in which said magnets are electromagnets.

9. The magnetron of claim 1 in combination in which said mode suppressing means consist of two concentric and co-planar metal rings each connected to different sets of alternate anode resonators in the axial mid-plane of said resonators to provide an anode structure having complete axial symmetry and to maintain said mode suppressing means at maximum distance from said end closures.

10. The magnetron combination of claim 1 in which all parts, including said anode structure, said end closures, said helical filament, said cylindrical filament support members and said antenna parts are completely symmetrical about the mid-plane of said magnetron perpendicular to its cylindrical axis.

* * * * *